US007683526B2

(12) United States Patent
Seo et al.

(10) Patent No.: US 7,683,526 B2
(45) Date of Patent: Mar. 23, 2010

(54) PLASMA DISPLAY APPARATUS WITH GLASS FILTER HAVING PLURALITY OF DOT PARTS

(75) Inventors: Sung-won Seo, Seoul (KR); Seung-won Jung, Suwon-si (KR)

(73) Assignee: Samsung Electronics, Co., Ltd., Suwon-si, Gyeonggi-do (KR)

( * ) Notice: Subject to any disclaimer, the term of this patent is extended or adjusted under 35 U.S.C. 154(b) by 858 days.

(21) Appl. No.: 11/232,880

(22) Filed: Sep. 23, 2005

(65) Prior Publication Data

US 2006/0208637 A1 Sep. 21, 2006

(30) Foreign Application Priority Data

Mar. 15, 2005 (KR) ..... 10-2005-0021537

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01J 1/30*** | (2006.01) |

(52) U.S. Cl. ..... 313/112; 313/582

(58) Field of Classification Search ..... 313/112, 313/582–587

See application file for complete search history.

(56) References Cited

U.S. PATENT DOCUMENTS

| | | | | |
|---|---|---|---|---|
| 2004/0009303 | A1 * | 1/2004 | Ito et al. | 427/421 |
| 2004/0160185 | A1 * | 8/2004 | Hatanaka et al. | 313/582 |
| 2004/0239252 | A1 * | 12/2004 | Akiyama et al. | 313/587 |
| 2006/0279211 | A1 * | 12/2006 | Park | 313/582 |

FOREIGN PATENT DOCUMENTS

| | | | |
|---|---|---|---|
| JP | 06-005203 | | 1/1994 |
| JP | 11231122 | A * | 8/1999 |
| JP | 2004-165237 | | 6/2004 |
| KR | 2001-0072984 | | 7/2001 |
| KR | 2002-0041493 | | 6/2002 |
| KR | 10-2004-0040049 | | 5/2004 |

* cited by examiner

*Primary Examiner*—Joseph L Williams
*Assistant Examiner*—Kevin Quarterman
(74) *Attorney, Agent, or Firm*—Roylance, Abrams, Berdo & Goodman, LLP

(57) ABSTRACT

A plasma display apparatus is provided having an improved glass filter. The plasma display includes a panel assembly, and a glass filter provided in front of the panel assembly. The glass filter includes a plurality of a dot parts disposed in front of a glass plate to adjust light transmissivity from the panel assembly and external light reflxibility. Thus, the glass filter may be produced simply, thereby lowering the production cost of the glass filter.

8 Claims, 4 Drawing Sheets

PLASMA DISPLAY APPARATUS WITH GLASS FILTER HAVING PLURALITY OF DOT PARTS

CROSS-REFERENCE TO RELATED APPLICATIONS

This application claims the benefit under 35 U.S.C. §119(a) of Korean Patent Application No. 2005-0021537, filed on Mar. 15, 2005, in the Korean Intellectual Property Office, the entire disclosure of which is hereby incorporated by reference.

BACKGROUND OF THE INVENTION

1. Field of Invention

The present invention relates to a plasma display apparatus. More particularly, the present invention relates to a plasma display apparatus having an improved glass filter disposed in front of a panel assembly.

2. Description of the Related Art

Generally, a plasma display apparatus displays a picture using a plasma display panel (PDP). The plasma display panel is capable of being produced in a large size without difficulty, as well as being relatively thin. Demands for such plasma display panels have been continuously increasing.

A conventional plasma display apparatus includes a panel assembly, a glass filter provided in front of the panel assembly, and a driver provided behind the panel assembly. Particularly, the glass filter, illustrated in FIG. 1, includes a glass 2 plate, a color film 4 provided in front of the glass 2 plate, an anti-reflection (AR) film 6 provided in front of the color film 4, and a mesh film 8 provided behind the glass plate 2.

The color film 4 adjusts light transmissivity from the panel assembly and embodies external colors. The AR film 6 adjusts external light reflexibility.

However, the process for making the glass filter 10 is relatively complex in the plasma display apparatus with the above-described construction. The color film 4 and the AR film 6 are attached in front of the glass panel 2 to adjust light transmissivity from the panel assembly and external light reflexibility.

Additionally, optical film, such as the color film 4 and the AR film 6, has a relatively high production cost, thereby causing high production costs to manufacture the glass filter 10.

Accordingly, a need exists for an improved glass filter for a plasma display apparatus that is simply and inexpensively manufactured.

SUMMARY OF THE INVENTION

Accordingly, it is an aspect of the present invention to provide a plasma display apparatus capable of functioning efficiently with a glass filter having a simple structure.

Additional aspects and advantages of the invention are set forth in part in the description that follows and, in part, are obvious from the description, or may be learned by practice of the invention.

The foregoing and other aspects of the present invention are achieved by providing a plasma display apparatus including a panel assembly and a glass filter provided in front of the panel assembly. The glass filter includes a glass plate, and a plurality of a dot parts printed in front of the glass plate that adjust light transmissivity from the panel assembly and external light reflexibility.

According to an aspect of the present invention, the plurality of the dot parts may adjust light transmissivity from the panel assembly and external light reflexibility by changing the area of the plurality of dot parts.

According to an aspect of the present invention, a plurality of the dot parts may be disposed regularly or irregularly in front of the glass plate.

According to an aspect of the present invention, an electromagnetic wave cut-off part may be disposed behind the glass plate.

According to an aspect of the present invention, the diameter of the plurality of dot parts may be formed smaller than each red, green, blue cell interval formed in the panel assembly.

According to an aspect of the present invention, the colors of the plurality of dot parts may be black, or other colors except black.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

These and other aspects and advantages of the present invention will become apparent and more readily appreciated from the following description of the embodiments, taken in conjunction with the accompany drawings, in which.

Throughout the drawings, like reference numerals will be understood to refer to like parts, components and structures.

DETAILED DESCRIPTION OF EXEMPLARY EMBODIMENTS

Reference will now be made in detail to the exemplary embodiments of the present invention, examples of which are illustrated in the accompanying drawings. The exemplary embodiments are described below with reference to the figures.

Figure 1:
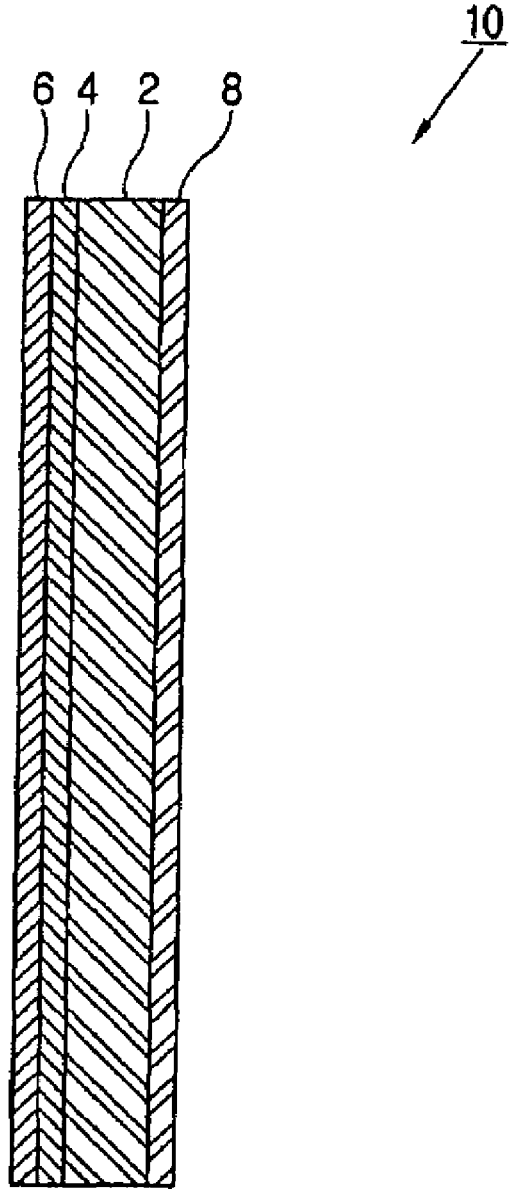
FIG. 1 (PRIOR ART)
FIG. 1 is an elevational view in cross section of a structure of a glass filter of a conventional plasma display apparatus.
Figure 2:
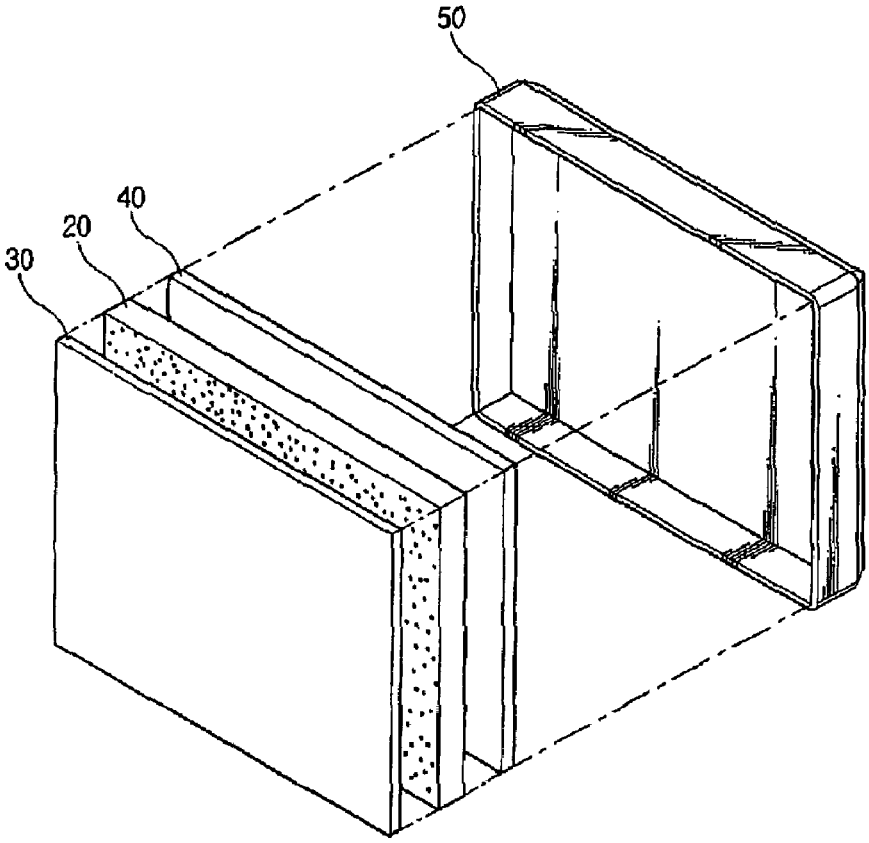
FIG. 2 is an exploded perspective view of a plasma display apparatus according to an exemplary embodiment of the present invention.
Figure 3:
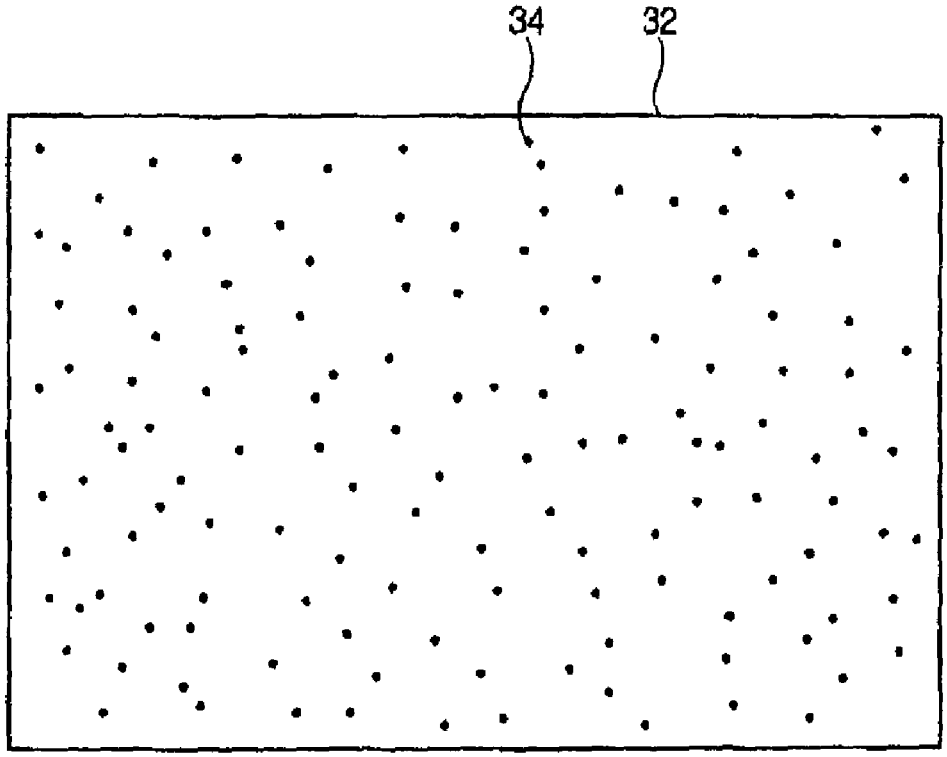
FIG. 3 is a front elevational view of a glass panel of a plasma display apparatus according to an exemplary embodiment of the present invention.
Figure 4:
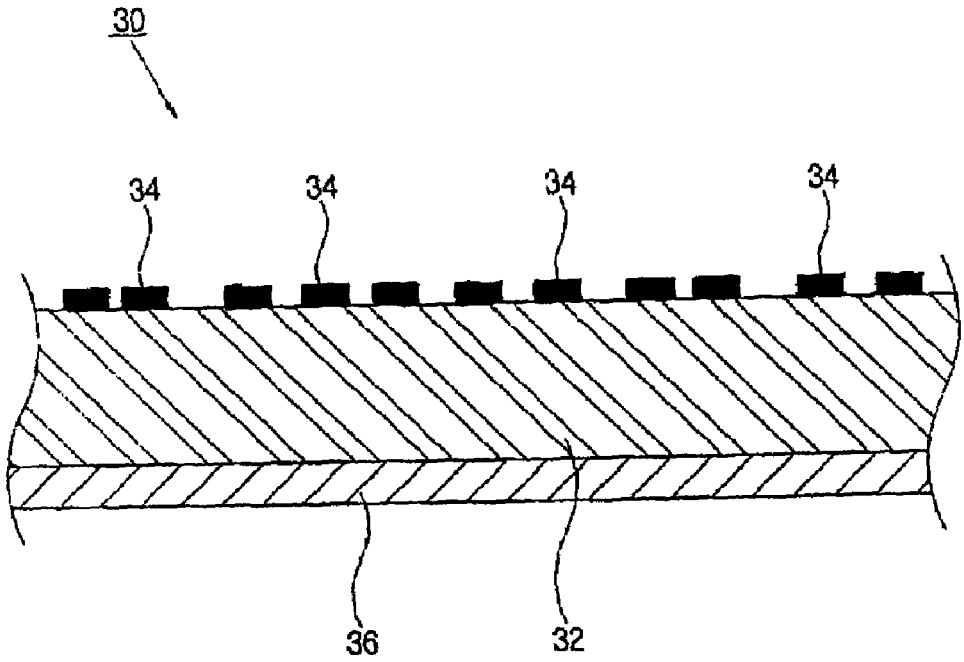
FIG. 4 is a sectional view illustrating a structure of a glass filter of a plasma display apparatus according to an exemplary embodiment of the present invention.

As illustrated in FIGS. 2 through 4, a plasma display apparatus according to an exemplary embodiment of the present invention includes a panel assembly 20, a glass filter 30 disposed in front of the panel assembly 20, a driver 40 disposed behind the panel assembly 20, and a casing 50 disposed rearwardly of the driver 40.

The panel assembly 20 is adapted to form a picture and, although not illustrated, has a front substrate, a rear substrate, and an electrode part between the front substrate and the rear substrate.

The electrode part formed in the panel assembly 20 is driven by the the driver 40.

The glass filter 30, as illustrated in FIG. 3 and FIG. 4, includes a glass plate 32, and a plurality of dot parts 34 printed in front of the glass 32, which have a predetermined length and shape.

The glass plate 32 may be selectively applied with material providing durability, heat resistance, and light transmissivity.

The plurality of the dot parts 34 adjusts light transmissivity from the panel assembly 20 and external light reflexibility, thereby functioning as a color film and an anti-reflection film.

Light from the panel assembly 20 passing through the glass plate 32 is partially cut-off by the plurality of the dot parts 34. Thus, the plurality of the dot parts 34 may adjust light transmissivity and decrease external reflexibility.

The size of the plurality of the dot parts 34 may be changed as necessary, therein capable of simply adjusting light transmissivity from the panel assembly 20 and external light reflexibility. Alternatively, the shape and size of each of the plurality of the dot parts 34 may be variously changed.

The size of the dot parts 34 may be formed smaller than each red, green, and blue cell interval formed in the panel assembly 20 to substantially prevent interfering with picture formation. For example, when each red, green, and blue cell interval is 0.3 mm, the size of the dot part 34 is preferably smaller than 0.3 mm.

The plurality of the dot parts 34 may be disposed regularly or irregularly on the glass plate 32. However when the plurality of the dot parts 34 are disposed regularly, a user may see the plurality of the dot parts 34 with naked eyes. Accordingly, it is preferable, but not necessary, that the plurality of the dot parts 34 be disposed irregularly.

The color of the plurality of dot parts 34 is preferably black. Alternatively, an external appearance thereof may be changed by changing the color.

The plurality of dot parts 34 may be simply formed by placing a photo mask with a dot shape on the glass 32 and sputtering ink, or by dipping a roll having dot-shaped projections in ink and rolling the roll on the glass plate 32.

An electromagnetic wave cut-off part 36 is disposed rearwardly of the glass 32 to efficiently cut-off electromagnetic waves from the panel assembly 20. The electromagnetic wave cut-off part 36 may selectively apply a mesh-type or a sputter-type using coating material with conductivity.

As described above, according to an exemplary embodiment of the present invention, the plurality of dot parts 34 are printed on the glass plate instead of an optical film. Therefore the glass filter may be produced simply, thereby lowering the production cost of the glass filter.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display apparatus, comprising:

a panel assembly; and a glass filter provided in front of the panel assembly, wherein the glass filter includes a glass plate; and a plurality of dot parts printed in front of the glass plate that adjust light transmissivity from the panel assembly and external light reflexibility, the plurality of dot parts being printable anywhere on the front of the glass plate and diameters of the plurality of dot parts being formed smaller than each red, green and blue cell interval formed in the panel assembly.

2. The plasma display apparatus of claim 1, wherein the plurality of the dot parts adjust light transmissivity from the panel assembly and external light reflexibility by changing an area of the plurality of the dot parts.

3. The plasma display apparatus of claim 1, wherein the plurality of the dot parts are disposed irregularly in front of the glass plate.

4. The plasma display apparatus of claim 2, wherein the plurality of the dot parts are disposed irregularly in front of the glass plate.

5. The plasma display apparatus of claim 1, wherein an electromagnetic wave cut-off part is disposed behind the glass plate.

6. The plasma display apparatus of claim 1, wherein the color of the plurality of dot parts is black.

7. The plasma display apparatus of claim 1, wherein the colors of the plurality of dot parts are colors other than black.

8. The plasma display apparatus of claim 1, wherein the plurality of the dot parts are disposed regularly in front of the glass plate.

* * * * *